US009102492B2

(12) United States Patent
Saito et al.

(10) Patent No.: US 9,102,492 B2
(45) Date of Patent: Aug. 11, 2015

(54) CLAMPING BINDING DEVICE

(71) Applicants: Takashi Saito, Kanagawa (JP); Katsuhiro Kosuge, Kanagawa (JP); Shingo Matsushita, Tokyo (JP); Yuusuke Shibasaki, Kanagawa (JP); Satoshi Saito, Kanagawa (JP); Makoto Hidaka, Tokyo (JP); Akihiro Musha, Kanagawa (JP); Takuya Morinaga, Tokyo (JP); Ikuhisa Okamoto, Kanagawa (JP); Shohichi Satoh, Kanagawa (JP); Nobuyoshi Suzuki, Tokyo (JP)

(72) Inventors: Takashi Saito, Kanagawa (JP); Katsuhiro Kosuge, Kanagawa (JP); Shingo Matsushita, Tokyo (JP); Yuusuke Shibasaki, Kanagawa (JP); Satoshi Saito, Kanagawa (JP); Makoto Hidaka, Tokyo (JP); Akihiro Musha, Kanagawa (JP); Takuya Morinaga, Tokyo (JP); Ikuhisa Okamoto, Kanagawa (JP); Shohichi Satoh, Kanagawa (JP); Nobuyoshi Suzuki, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 13/862,676

(22) Filed: Apr. 15, 2013

(65) Prior Publication Data

US 2013/0270762 A1 Oct. 17, 2013

(30) Foreign Application Priority Data

Apr. 16, 2012 (JP) ..... 2012-093146
Jan. 30, 2013 (JP) ..... 2013-015766

(51) Int. Cl.

| | |
|---|---|
| ***B65H 37/04*** | (2006.01) |
| ***B65H 39/00*** | (2006.01) |
| ***B42C 1/12*** | (2006.01) |
| ***B65H 29/58*** | (2006.01) |

(Continued)

(52) U.S. Cl.
CPC *B65H 39/00* (2013.01); *B42C 1/12* (2013.01); *B65H 29/58* (2013.01); *B65H 31/26* (2013.01); *B65H 39/10* (2013.01); *B65H 2405/57* (2013.01); *B65H 2511/20* (2013.01); *B65H 2513/41* (2013.01); *B65H 2701/1313* (2013.01)

(58) Field of Classification Search
CPC ..... B65H 37/04
USPC ..... 270/58.07, 58.08; 399/408, 410
See application file for complete search history.

(56) References Cited

U.S. PATENT DOCUMENTS 3,577,575 A * 5/1971 Taniguchi ..... 7/158
8,235,375 B2 * 8/2012 Shiraishi ..... 270/58.09

(Continued)

FOREIGN PATENT DOCUMENTS

CN 102190200 A 9/2011
CN 102275762 A 12/2011

(Continued)

OTHER PUBLICATIONS

Chinese Office Action for Corresponding Chinese Patent Application No. 201310118217.8 dated Mar. 27, 2015.

*Primary Examiner* — Patrick Mackey
(74) *Attorney, Agent, or Firm* — Harness, Dickey & Pierce, P.L.C.

(57) ABSTRACT

A sheet processing apparatus includes a conveyance unit to transport a sheet bundle including multiple sheets in a sheet conveyance direction and a binding device including a clamping unit. The clamping unit includes multiple projections and multiple recesses to engage the respective projections to clamp the sheet bundle inserted therebetween. At least one of the multiple projections includes an inclined portion facing a sheet conveyance direction, and an inclination of the inclined portion is 45 degrees or smaller relative to a face parallel to the sheet conveyance direction.

10 Claims, 17 Drawing Sheets

(51) Int. Cl.
*B65H 31/26* (2006.01)
*B65H 39/10* (2006.01)

(56) References Cited

U.S. PATENT DOCUMENTS

| | | | | |
|---|---|---|---|---|
| 8,246,033 | B2 * | 8/2012 | Sato | 270/58.09 |
| 8,297,610 | B2 * | 10/2012 | Shiraishi | 270/58.09 |
| 8,413,979 | B2 * | 4/2013 | Sato | 270/58.08 |
| 8,444,133 | B2 * | 5/2013 | Kimura | 270/58.08 |
| 8,540,228 | B2 * | 9/2013 | Shiraishi | 270/58.09 |
| 8,662,488 | B2 * | 3/2014 | Awano | 270/58.08 |
| 2003/0151187 | A1 | 8/2003 | Suzuki et al. | |
| 2003/0160376 | A1 | 8/2003 | Yamada et al. | |
| 2003/0219295 | A1 | 11/2003 | Saitoh et al. | |
| 2003/0234487 | A1 | 12/2003 | Tamura et al. | |
| 2004/0070133 | A1 | 4/2004 | Yamada et al. | |
| 2010/0202814 | A1 * | 8/2010 | Nakamura | 399/408 |
| 2010/0280814 | A1 * | 11/2010 | Rabinovitch et al. | 703/16 |
| 2010/0290826 | A1 * | 11/2010 | Kawaguchi et al. | 399/408 |
| 2011/0222945 | A1 * | 9/2011 | Sato | 399/408 |
| 2011/0233844 | A1 * | 9/2011 | Shiraishi et al. | 270/58.11 |
| 2011/0304089 | A1 | 12/2011 | Kimura | |
| 2013/0154178 | A1 * | 6/2013 | Suzuki et al. | 270/58.08 |

FOREIGN PATENT DOCUMENTS

| | | | |
|---|---|---|---|
| JP | 36-013206 | | 5/1961 |
| JP | 37-007208 | | 4/1962 |
| JP | 2000318918 | A | 11/2000 |
| JP | 2004-155537 | | 6/2004 |
| JP | 2004155537 | A * | 6/2004 |
| JP | 4044416 | B2 | 2/2008 |
| JP | 2010-184769 | | 8/2010 |

* cited by examiner

CLAMPING BINDING DEVICE

CROSS-REFERENCE TO RELATED APPLICATIONS

This patent application is based on and claims priority pursuant to 35 U.S.C. §119 to Japanese Patent Application Nos. 2012-093146, filed on Apr. 16, 2012, and 2013-015766, filed on Jan. 30, 2013, in the Japan Patent Office, the entire disclosure of each of which is hereby incorporated by reference herein.

BACKGROUND OF THE INVENTION

1. Field of the Invention

The present invention generally relates to a sheet processing apparatus to bind together a bundle of sheets and an image forming system including the sheet processing apparatus and an image forming apparatus, such as a copier, a facsimile machine, a printer, or multifunction machine capable of at least two of these functions.

2. Description of the Background Art

There are sheet processing apparatuses, so-called finishers or post-processing apparatuses, that align a bundle of sheets (hereinafter "a sheet bundle") output from an image forming apparatus and bind the sheet bundle with metal staples. Such sheet processing apparatuses can automatically staple a number of sheet bundles on which images are formed and are widely used for convenience and efficiency thereof.

From the viewpoint of environmental preservation, it is desirable to recycle printed paper. To recycle sheet bundles bound with staples such as those made of metal, it is necessary to remove and separate the staples from paper. Thus, it is not convenient. Additionally, the removed staples are wasted.

By contrast, there are hand-held staplers, so-called staple guns or powered staplers, capable of binding sheets without staples. For example, JP-S36-13206-Y discloses a hand-held stapler capable of clamp binding, and JP-S37-7208-Y discloses a hand-held stapler that makes cut holes in sheets, bends cut portions, and inserts the cut portions into the cut holes.

There are hand-held staplers that press (that is, emboss) multiple sheets with a pair of tooth forms, causing fibers of the sheets to tangle with each other, and thereby tie the sheets together. Alternatively, sheets are bound together using other types of processing such as half blanking, lancing, bending, and inserting. Sheets bundles free of staples can be directly put through a shredder. Thus, such binding tools can reduce consumption of consumables, make recycling easier, and be effective to save resources.

For example, JP-2010-184769-A proposes a sheet binding device that involves embossing and binds sheets according to the thickness of the sheet bundle with a simple configuration. Specifically, the sheet binding device forms projections and recesses in the direction of the thickness of a sheet bundle using a pair of tooth forms, thereby binding the sheet bundle. The pair of tooth forms is movable in the thickness direction of the sheet bundle and configured to clamp the sheet bundle to form the projections and the recesses in the thickness direction. During embossing, the interval between the tooth forms in the thickness direction of the sheet bundle is changed according to the thickness of the sheet bundle.

SUMMARY OF THE INVENTION

One embodiment of the present invention provides a sheet processing apparatus that includes a conveyance unit to transport a sheet bundle including multiple sheets in a sheet conveyance direction and a binding device including a clamping unit. The clamping unit includes multiple projections and multiple recesses to engage the respective projections to clamp the sheet bundle inserted therebetween. At least one of the multiple projections includes an inclined portion facing a sheet conveyance direction, and an inclination of the inclined portion is 45 degrees or smaller relative to a face parallel to the sheet conveyance direction.

In another embodiment, an image forming system includes an image forming apparatus and either of the above-described sheet processing apparatuses.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1B:
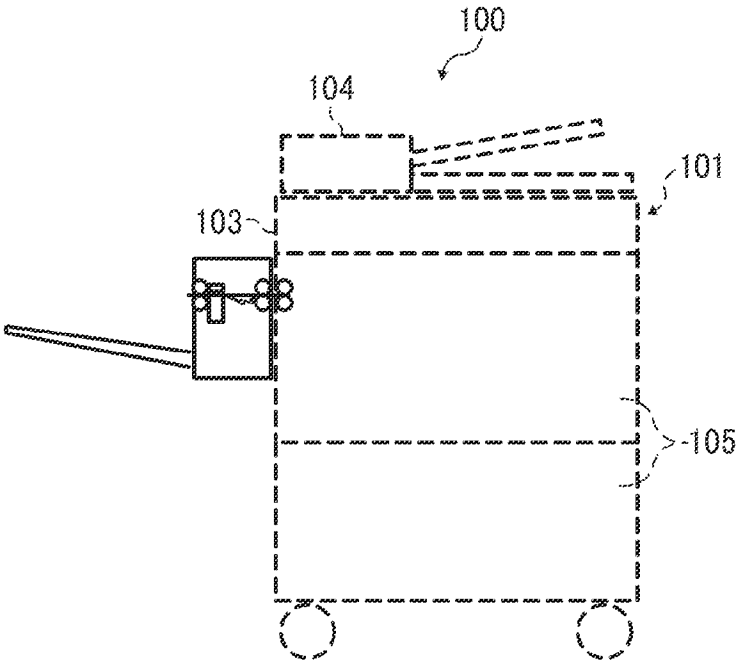
FIGS. 1A and 1B are schematic diagrams illustrating two states of an image forming system according to an embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

It is to be noted that the term "sheet" used in this specification includes recording media sheets.

Referring now to the drawings, wherein like reference numerals designate identical or corresponding parts throughout the several views thereof, and particularly to FIG. 1, a system including an image forming apparatus and a sheet processing apparatus according to an embodiment of the present invention is described.

Figure 1A:
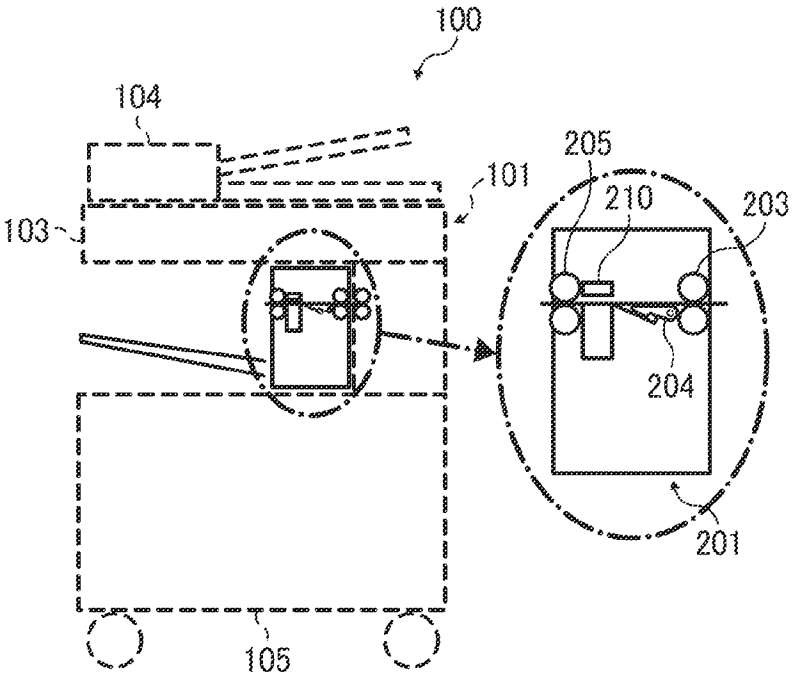

FIGS. 1A and 1B are schematic diagrams illustrating two states of an image forming system according to an embodiment of the present invention. An image forming system 100 according to the present embodiment includes an image forming apparatus 101 and a sheet processing apparatus (i.e., a finisher or post-processing apparatus) 201. The sheet processing apparatus 201 includes a sheet binding mechanism and disposed inside a conveyance channel through which sheets are output from the image forming apparatus 101. Thus, the sheet processing apparatus 201 is a channel-internal binding apparatus. The sheet processing apparatus 201 is disposed inside the conveyance channel of the image forming apparatus 101 in FIG. 1A and outside the conveyance channel in FIG. 1B.

The sheet processing apparatus 201 has two capabilities, aligning sheets stacked inside the conveyance channel and stapling the sheets inside the conveyance channel. In FIG. 1A, the sheet processing apparatus 201 processes sheets inside the housing of the image forming apparatus 101 and thus is also called a housing-internal processing device. Thus, the sheet processing apparatus 201 according to the present embodiment is compact and can be mounted inside the housing or to a side of the image forming apparatus 101 in accordance with the configuration thereof.

The image forming apparatus 101 includes an image forming engine 105, an image reader 103 to read and convert images into image data, and an automatic document feeder (ADF) 104. The image forming engine 102 includes an image processing unit and a sheet feeder. In the state shown in FIG. 1A, a discharge tray to which sheets on which images are formed are output is formed inside the housing of the image forming apparatus 101. In the state shown in FIG. 1B, the discharge tray is positioned outside the image forming apparatus 101.

Figure 2:
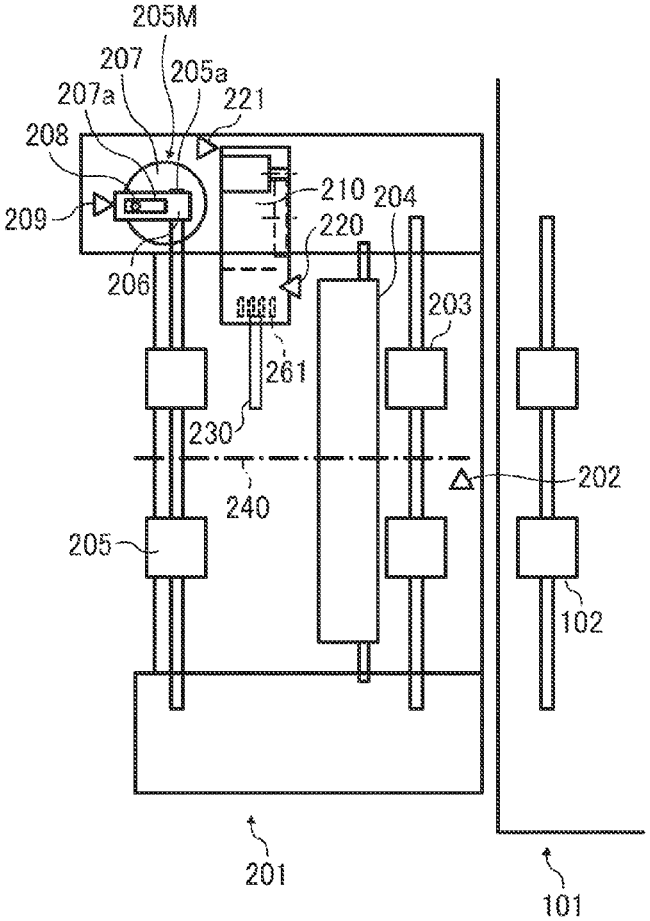
FIG. 2 is a plan view of a sheet processing apparatus shown in FIGS. 1A and 2B.
Figure 3:
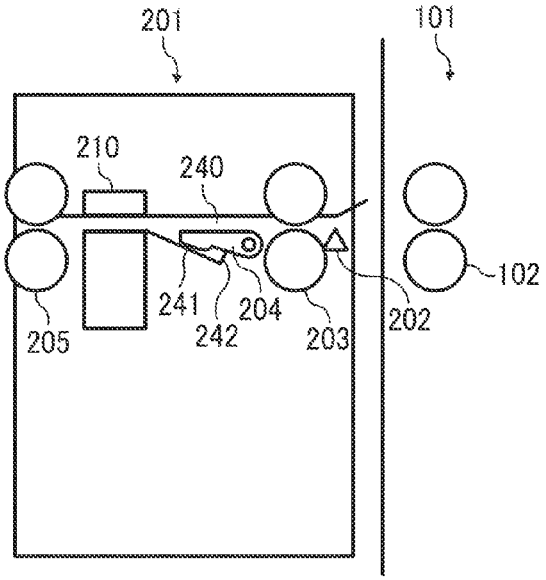
FIG. 3 is a front view of the sheet processing apparatus shown in FIGS. 1A and 1B.

FIGS. 2 and 3 are respectively a plan view and a front view of the sheet processing apparatus 201 shown in FIGS. 1A and 2B. In the configuration shown in FIGS. 2 and 3, the sheet processing apparatus 201 includes an entry detector 202, a pair of entrance rollers 203, a branch pawl 204, a binding device 210, and a pair of discharge rollers 205, and these components are arranged in that order from an entrance side along a conveyance channel 240. The entry detector 202 detects the presence of a sheet received in the sheet processing apparatus 201 after discharged from the image forming apparatus 101. Specifically, the entry detector 202 detects the leading end and the trailing end of the sheet. For example, the entry detector 202 can be a reflection type photosensor. Alternatively, a transmission-type photosensor may be used. The entrance rollers 203 are positioned at the entrance of the sheet processing apparatus 201 to receive sheets discharged by discharge rollers 102 of the image forming apparatus 101 and forward the sheets to the binding device 210. Additionally, a drive source, such as a drive motor, is provided for the entrance rollers 203 and a controller, such as a central processing unit (CPU) controls the stop, rotation, and a conveyance amount of the drive source. The entrance rollers 203 correct skew of the sheet with the leading end of the sheet stuck in a nip between the entrance rollers 203.

The branch pawl 204 is disposed downstream from the entrance rollers 203 in the direction in which the sheet is transported (hereinafter "sheet conveyance direction"). The branch pawl 204 guides the trailing end of the sheet to a bifurcation channel 241. In this case, after the trailing end of the sheet passes by the branch pawl 204, the branch pawl 204 pivots clockwise in FIG. 3, thereby transporting the sheet in reverse. Thus, the trailing end of the sheet is led to the bifurcation channel 241. The branch pawl 204 can pivot driven by a solenoid 250 shown in FIG. 4, which is described in further detail later. Instead of the solenoid 250, a motor may be used. When the branch pawl 204 pivots counterclockwise in FIG. 3, the branch pawl 204 can press a single sheet or multiple sheets against a conveyance face of the bifurcation channel 241. Thus, the branch pawl 204 can retain the single or multiple sheets not to move in the bifurcation channel 241.

The discharge rollers 205 are disposed immediately upstream from the exit of the conveyance channel 240 of the sheet processing apparatus 201. The discharge rollers 205 transport, shift, and discharge the sheets. A drive source for the discharge rollers 205 is provided similarly to the entrance rollers 203, and the controller controls the stop, rotation, and a conveyance amount thereof. A shift mechanism 205M (shown in FIG. 2) shifts the discharge rollers 205. The shift mechanism 205M includes a shift link 206, a shift cam 207, a cam stud 208, and a home position (HP) detector 209.

The entrance rollers 203 and the discharge rollers 205 together form a conveyance unit to transport the sheet bundle 272.

The shift link 206 is provided to a shaft end 205*a* of the discharge rollers 205 and receives a force for shifting the discharge rollers 205. The shift cam 207 is a rotary disc-shaped member and includes the cam stud 208. For example, the shaft of the discharge rollers 205 is movably inserted into a shift link slot 207*a* via the cam stud 208, and the discharge rollers 205 are moved in a direction perpendicular to the sheet conveyance direction by rotation of the shift cam 207. Thus, the discharge rollers 205 are shifted. The cam stud 208 is geared to the shift link slot 207*a* and converts the rotational motion of the shift cam 207 to linear movement in the axial direction of the discharge rollers 205. The HP detector 209 detects a position of the shift link 206, and the detected position is deemed a home position of the shift link 206, used as a reference to control rotation of the shift cam 207. The rotation of the shift is controlled by the above-described controller.

The binding device 210 includes a sheet end detector 220, a binding home position (HP) detector 221, and a guide rail 230 to guide movement of the binding device 210. The binding device 210 is a so-called stapler to bind together multiple sheets into a sheet bundle. In the present embodiment, the binding device 210 squeezes sheets using a pair of tooth forms 261, thereby deforming the sheets so that fibers thereof tangle each other. This is called clamp binding. There are hand-held staplers to binds sheets using half blanking, lancing, bending, and inserting in addition to clamp binding. Such binding methods without metal staplers reduce consumption of consumables, make recycling easier, and enable shredding of sheet bundles as is. Therefore, such binding methods in which sheets are bound using sheets alone are preferable also in sheet processing apparatuses.

The sheet end detector 220 detects a lateral end of the sheet, and sheets are aligned with reference to the position detected by the sheet end detector 220. The binding HP detector 221 is movable in a sheet width direction perpendicular to the sheet conveyance direction and detects a position of the binding device 210. The home position of the binding device 210 is set to a position not to interfere with a maximum size sheet processed by the image forming system 100. The guide rail 230 guides the binding device 210 so that the binding device 210 can move reliably in the sheet width direction. The guide rail 230 extends in a range to guide the binding device 210 moving in the direction perpendicular to the conveyance channel 240 (sheet conveyance direction) from the home position to a position to binds a smallest sheets processed by the image forming system 100. A shift unit including a drive motor moves the binding device 210 along the guide rail 230.

The conveyance channel 240 extends from the entrance of the sheet processing apparatus 201 to the exit thereof. The bifurcation channel 241 bifurcates from the conveyance channel 240. The sheet is transported in reverse (switchback) and transported from the trailing end to the bifurcation channel 241. The bifurcation channel 241 serves as a stacking channel in which multiple sheets are stacked and aligned. The sheets are transported so that the trailing ends thereof contact a contact face 242 provided at a downstream end of the bifurcation channel 241. Thus, the contact face 242 serves as a reference plane to align the trailing end of the sheets. The pair of tooth forms 261 in the present embodiment has multiple projections and multiple recesses mating with each other. The pair of tooth forms 261 squeezes the sheets for clamp binding.

Figure 4:
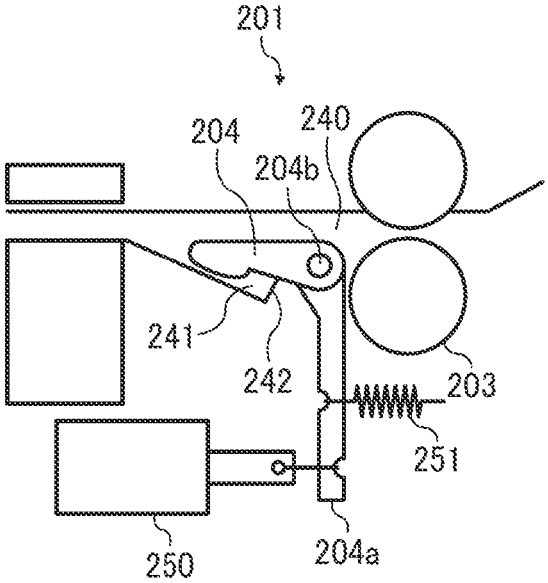
FIG. 4 is a schematic diagram illustrating a main portion of the sheet processing apparatus when a branch pawl is at a position for transporting sheets.
Figure 5:
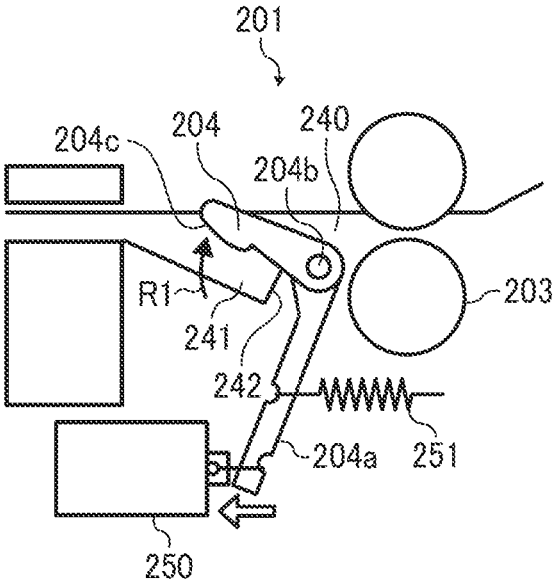
FIG. 5 is a schematic diagram illustrating the main portion of the sheet processing apparatus when the branch pawl is at a position for switchback operation.

FIGS. 4 and 5 are schematic diagrams illustrating a main portion around the branch pawl 204 of the sheet processing apparatus 201. FIG. 4 illustrates a state in which the branch pawl 204 forwards the sheet along the conveyance channel 240, and FIG. 5 illustrates switchback operation. The branch pawl 204 is pivotable in a predetermined angle range relative to a support shaft 204*b* to switch the sheet conveyance route between the conveyance channel 240 and the bifurcation channel 241. The position of the branch pawl 204 shown in FIG. 4 serves as a home position to forward the sheet received from the right in FIG. 4 to the downstream side without interfering it. A spring 251 constantly and elastically biases the branch pawl 204 counterclockwise in FIG. 4.

The spring 251 is hooked to a lever 204*a* to which a plunger of the solenoid 250 is connected. It is to be noted that the sheet can be kept clamped inside the bifurcation channel 241 when the branch pawl 204 returns to the position shown in FIG. 4 after the sheet is transported to the branch pawl 204 in the state shown in FIG. 5. The conveyance route can be switched by turning on and off the solenoid 250. Specifically, as the solenoid 250 turns on, the branch pawl 204 rotates in the direction indicated by arrow R1 shown in FIG. 5, blocking the conveyance channel 240 and opening the bifurcation channel 241. Thus, the sheet is led to the bifurcation channel 241.

Figure 6:
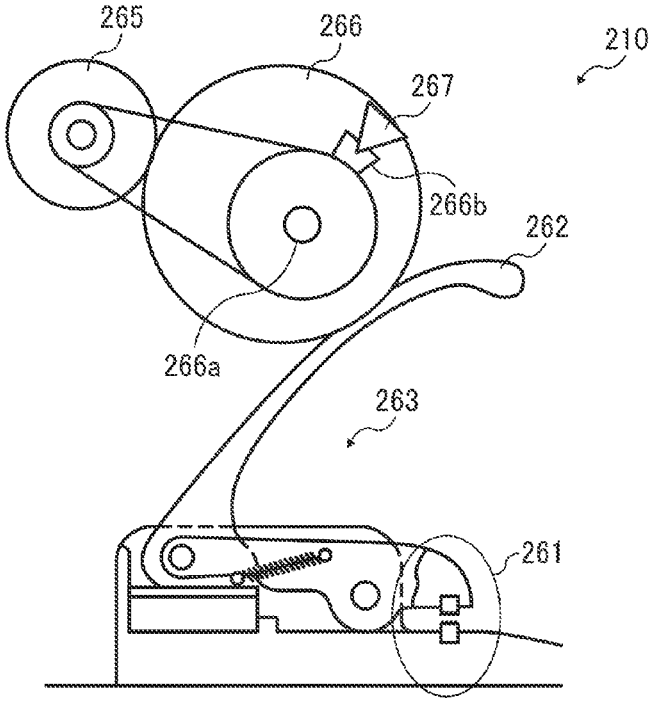
FIG. 6 is a schematic view of a binding device at a position for receiving sheets.
Figure 7:
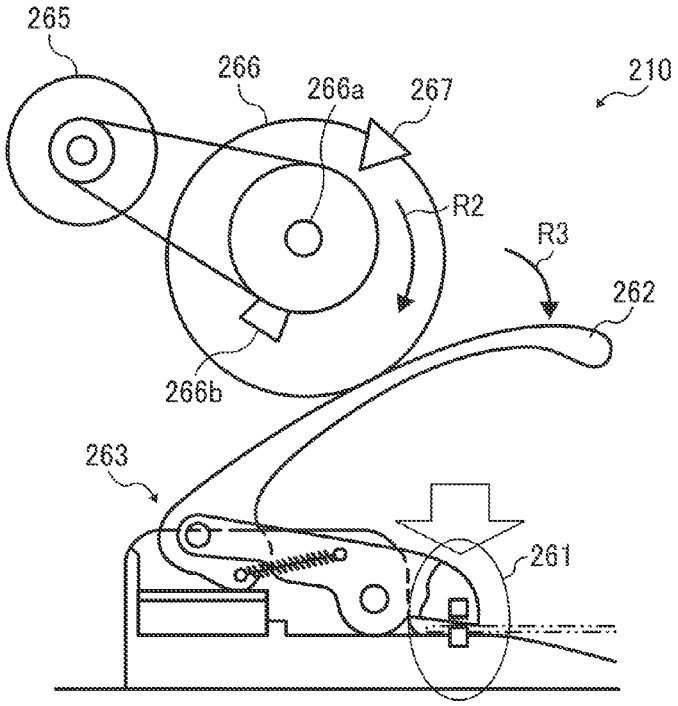
FIG. 7 is a schematic view of the binding device at a position for binding sheets.

FIGS. 6 and 7 illustrate a configuration of the binding device 210 according to the present embodiment. The binding device 210 includes the pair of tooth forms 261, a pressure lever 262, a group of links 263, a drive motor 265, an eccentric cam 266, and a cam home position (HP) detector 267. The tooth forms 261 are arranged vertically in pair and shaped to engage each other. The pair of tooth forms 261 is positioned at an output end of the group of links 263 combined together, and the pressure lever 262 is positioned at an input end (driving end) of the group of links 263. The tooth forms 261 engage and are disengaged from each other as the pressure lever 262 applies pressure to and release the pressure.

The pressure lever 262 is rotated by the eccentric cam 266. The drive motor 265 drives the eccentric cam 266, and the rotational position thereof is controlled with reference to detection by the cam HP detector 267. The rotational position of the eccentric cam 266 defines the distance from a rotation axis 266*a* and to a cam surface thereof, based on which the pressing amount by the pressure lever 262 is determined. The home position of the eccentric cam 266 is set to a position at which a feeler 266*b* provided to the eccentric cam 266 is detected by the cam HP detector 267. As shown in FIG. 6, when the eccentric cam 266 is at the home position, the tooth forms 261 are disengaged from each other. In this state, binding is not feasible and sheets can be received in the binding device 210.

For binding sheets, the sheets are inserted between the tooth forms 261 at the position shown in FIG. 6, and then the drive motor 265 rotates. When the drive motor 265 starts rotating, the eccentric cam 266 rotates in the direction indicated by arrow R2 shown in FIG. 7. As the eccentric cam 266 rotates, the cam surface thereof shifts, and the pressure lever 262 rotates in the direction indicated by arrow R3 shown in FIG. 7. The force of rotation increases in strength through the group of links 263 using leverage and is transmitted to the pair of tooth forms 261 at the output end.

When the eccentric cam 266 rotates a predetermined amount, the upper and lower tooth forms 261 engage each other, thus squeezing the sheets interposed therebetween. The squeezed sheets deform, and fibers of adjacent sheets tangle each other. Subsequently, the drive motor 265 rotates in reverse and stops in response to a detection result generated by the cam HP detector 267. Then, the upper and lower tooth forms 261 return to the state shown in FIG. 6 and become capable of transporting the sheets. The pressure lever 262 has a capability of spring and can deform to let an excessive load out when the excessive load is applied thereto.

FIGS. 8A through 16B illustrate online binding operation performed by the binding device 210 of the sheet processing apparatus 201. Among FIGS. 8A through 16B, the drawings given number with subscript "A" are plan views, and drawings given number with subscript "B" are front views. Additionally, the term "online binding" means that, after the image forming apparatus 101 forms images on the sheets, the sheets are consecutively received by the sheet processing apparatus 201 disposed at the discharge port of the image forming apparatus 101, aligned, and bound thereby. By contrast, the term "independent binding" and "offline binding" mean that the binding device 210 of the sheet processing apparatus 201 binds sheets independently from the image forming apparatus 101, and the sheets thus bound are not limited to those outputs from the image forming apparatus 101. Offline binding is not consecutive with image formation by the image forming apparatus 101.

Figure 8A:
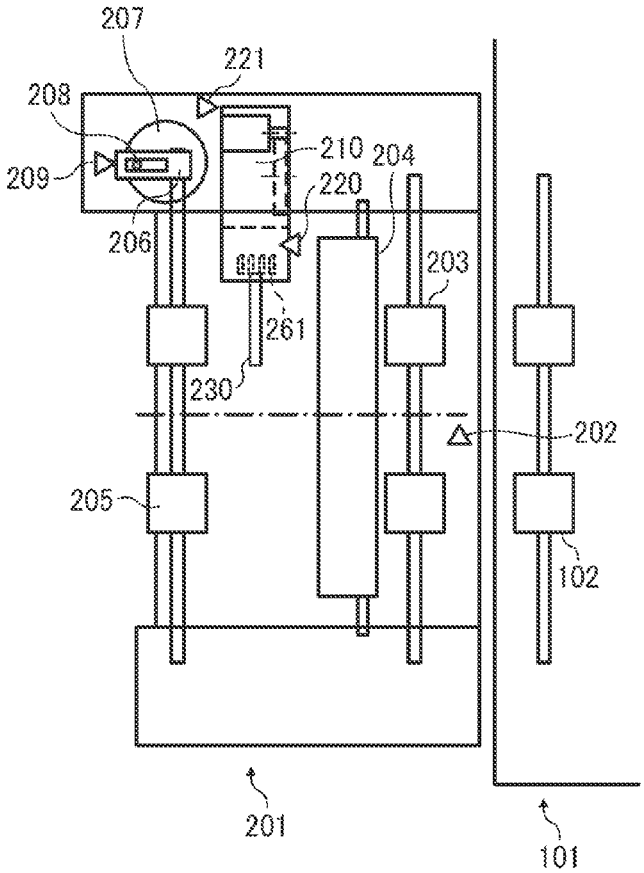
FIGS. 8A and 8B illustrate the sheet processing apparatus being in an initial stage of online binding.
Figure 8B:
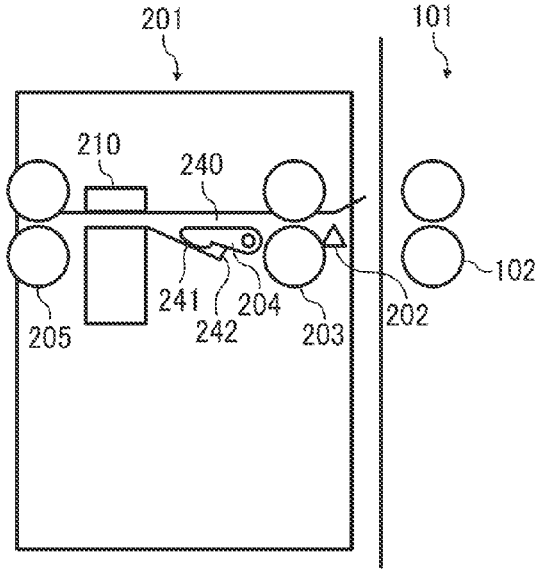

FIGS. 8A and 8B illustrate the sheet processing apparatus 201 being in an initial stage of online binding. Referring to FIGS. 8A and 8B, when the image forming apparatus 101 starts outputting sheets, the respective components of the sheet processing apparatus 201 move to their home positions, thus completing the initial stage.

Figure 9A:
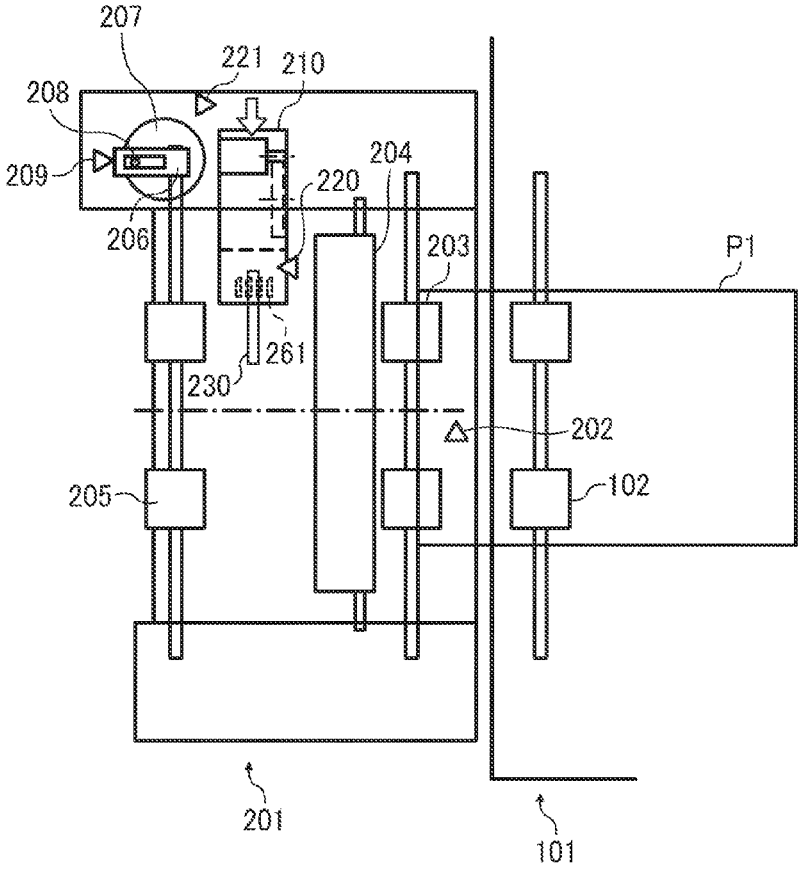
FIGS. 9A and 9B illustrates a state immediately after a first sheet output from an image forming apparatus is received in the sheet processing apparatus.
Figure 9B:
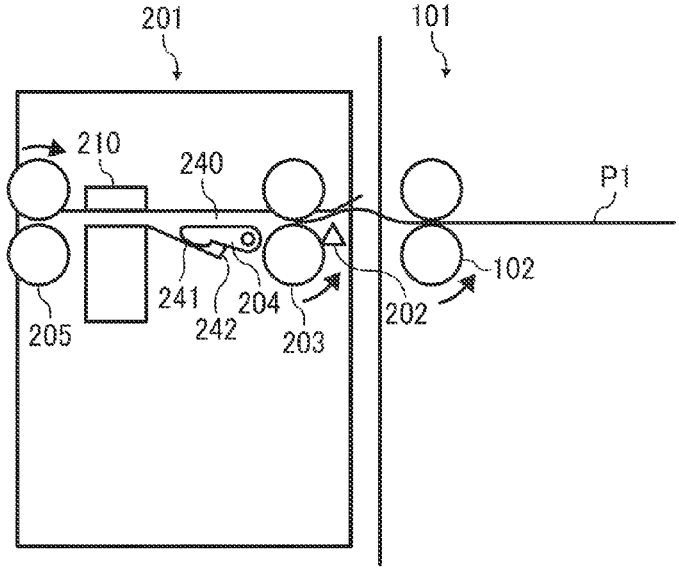

FIGS. 9A and 9B illustrates a state immediately after a first sheet P1 output from the image forming apparatus 101 is received in the sheet processing apparatus 201. Before the first sheet P1 is received by the sheet processing apparatus 201, the controller of the sheet processing apparatus 201 obtains sheet processing data such as processing type and sheet data (sheet-related variables) and enters a standby state for receiving sheets according to the data.

The processing types include straight transport, shifted discharge, and binding. For the straight transport, the entrance rollers 203 and the discharge rollers 205 start rotating in the sheet conveyance direction in the standby state, and the first sheet P1 through a last sheet Pn are transported sequentially. After the last sheet Pn is discharged, the entrance rollers 203 and the discharge rollers 205 stop. It is to be noted that "n" is an integer equal to greater than "2".

For the shifted discharge, the entrance rollers 203 and the discharge rollers 205 start rotating in the sheet conveyance direction in the standby state. In the shifted discharge, after the trailing end of the first sheet P1 exits from the entrance rollers 203, the shift cam 207 rotates a predetermined amount, and the discharge rollers 205 move in the axial direction. At that time, the first sheet P1 moves together with the discharge rollers 205. After the first sheet P1 is discharged, the shift cam 207 rotates to the home position and is prepared for the subsequent sheet. This shifting operation is repeated until the last sheet Pn of that copy (a bundle) is discharged. Thus, a bundle of sheets, to be bound into a sheet bundle 272, is stacked, shifted to one side. When a first sheet P1 of a subsequent copy is received, the shift cam 207 rotates in the direction reverse to the direction for the previous copy.

For binding, in the standby state, the entrance rollers 203 are motionless, and the discharge rollers 205 start rotating in the sheet conveyance direction. Additionally, the binding device 210 moves to a standby position withdrawn a predetermined amount from the sheet width and goes standby. In this case, the entrance rollers 203 also serve as a pair of registration rollers. Specifically, the first sheet P1 is received in the sheet processing apparatus 201. Then, the leading end of the sheet is detected by the entry detector 202 and gets stuck in the nip between the entrance rollers 203. Further, with the leading end thereof stuck in the entrance rollers 203, the first sheet P1 is transported by the discharge rollers 102 of the image forming apparatus 101 by an amount to cause slackening. Subsequently, the entrance rollers 203 start rotating. Thus, skew of the first sheet P1 is corrected. FIGS. 9A and 9B illustrate this state.

Figure 10A:
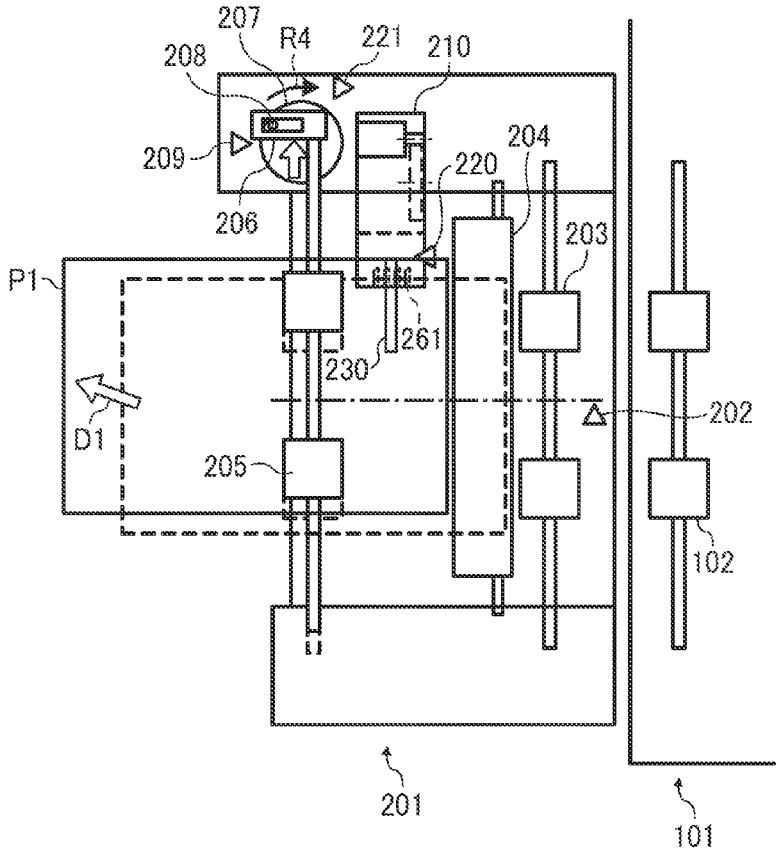
FIGS. 10A and 10B illustrate a state in which the trailing end of the sheet released from a nip between a pair of entrance rollers is beyond a bifurcation channel.
Figure 10B:
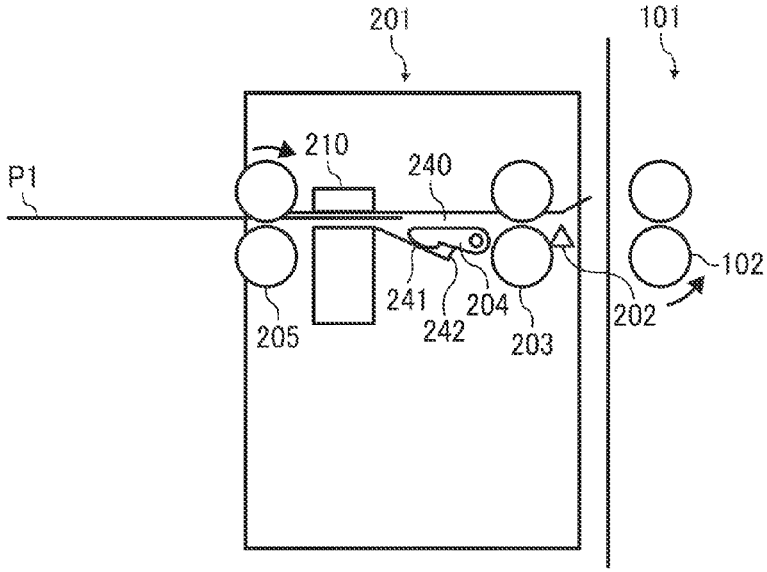

FIGS. 10A and 10B illustrates a state in which the trailing end of the sheet is released from the nip between the entrance rollers 203 and gets beyond the bifurcation channel 241. The conveyance amount of the first sheet P1 is measured based on the detection of the trailing end of the sheet by the entry detector 202, and thus the controller recognizes the position of the first sheet P1. After the trailing end of the sheet passes by the nip between the entrance rollers 203, the entrance rollers 203 stop rotating to receive the second sheet P2. Simultaneously, the shift cam 207 rotates in the direction indicated by arrow R4 shown in FIG. 10A (clockwise in FIG. 10A). The discharge rollers 205 start moving in the axial direction with the first sheet P1 clamped in the nip thereof. Thus, the first sheet P1 is transported while being moved obliquely as indicated by arrow D1 in FIG. 10A, obliquely to the sheet conveyance direction. Subsequently, when the sheet end detector 220, disposed adjacent to or incorporated in the binding device 210, detects the lateral end of the sheet P, the shift cam 207 stops and rotates in reverse. Then, the shift cam 207 stops in a state in which the sheet end detector 220 does not detect the presence of the sheet P. When the trailing end of the sheet P reaches a predetermined position beyond a leading end of the branch pawl 204, the discharge rollers 205 stop.

Figure 11A:
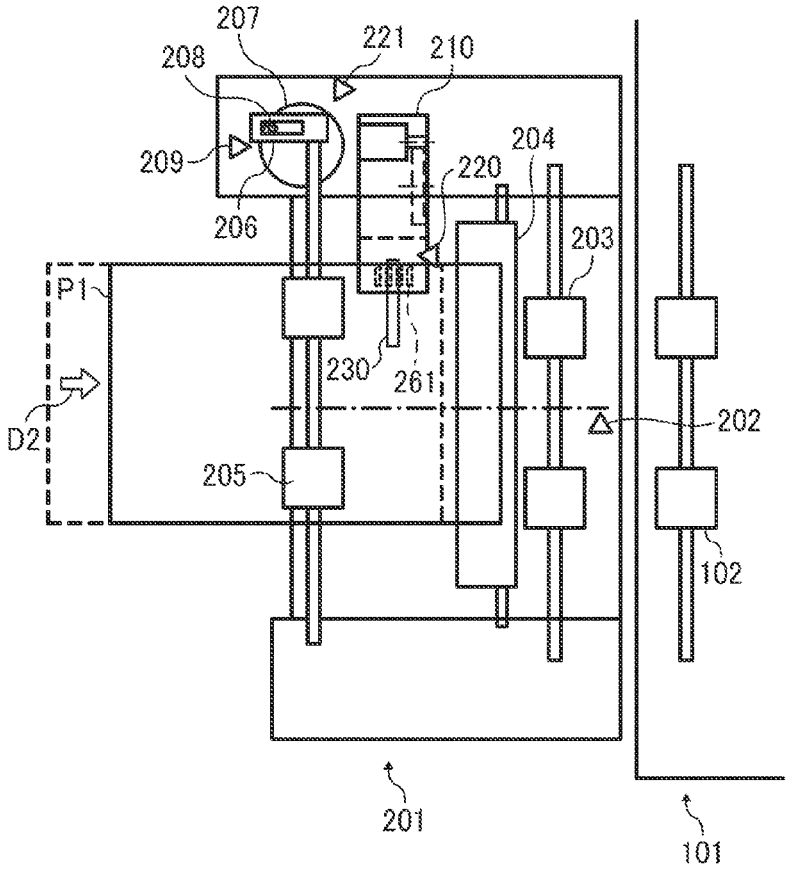
FIGS. 11A and 11B illustrate the switchback operation for changing a conveyance route in which the sheet is transported.
Figure 11B:
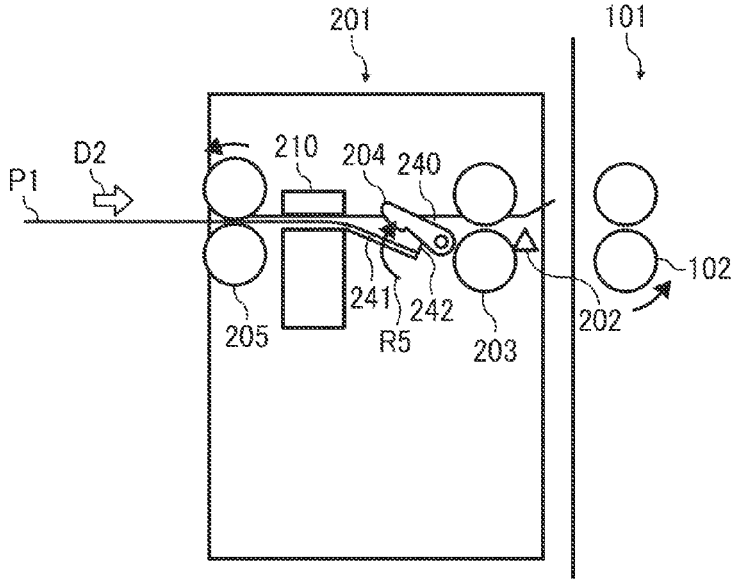

FIGS. 11A and 11B illustrate the switchback operation for changing the conveyance route in which the sheet P1 is transported. Subsequent to the state shown in FIGS. 10A and 10B, the branch pawl 204 is rotated in the direction indicated by arrow R5 shown in FIG. 11B to switch the conveyance route to the bifurcation channel 241, after which the discharge rollers 205 are rotated in reverse. With this operation, the first sheet P1 is switchbacked in the direction indicated by arrow D2 (hereinafter "direction D2"), and the trailing end of the first sheet P1 enters the bifurcation channel 241. Further, the trailing end of the sheet contacts the contact face 242 and is aligned with reference to the contact face 242. When the first sheet P1 is thus aligned, the discharge rollers 205 stop. At that time, the discharge rollers 205 slip as the trailing end of the first sheet P1 contacts the contact face 242 so as not to apply conveyance force thereto. In other words, the discharge rollers 205 no longer buckle the first sheet P1 after the trailing end of the switchbacked first sheet P1 is aligned by the contact face 242.

Figure 12A:
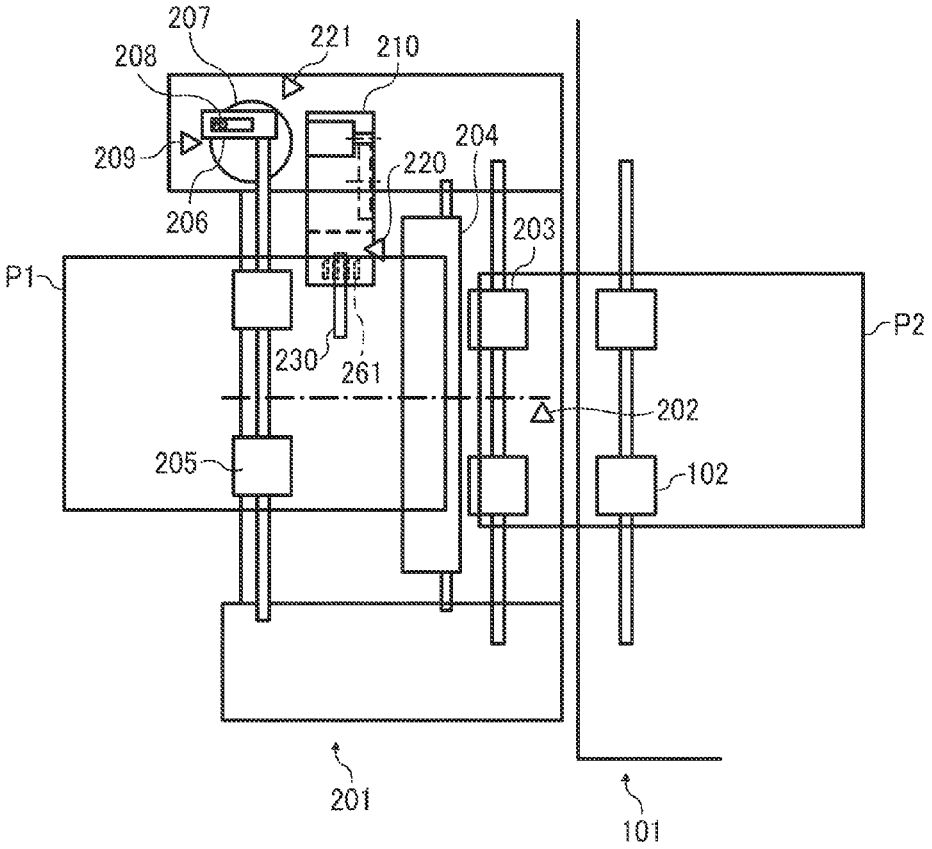
FIGS. 12A and 12B illustrate a state in which the first sheet is retained in the bifurcation channel, and a second sheet is received in the sheet processing apparatus.
Figure 12B:
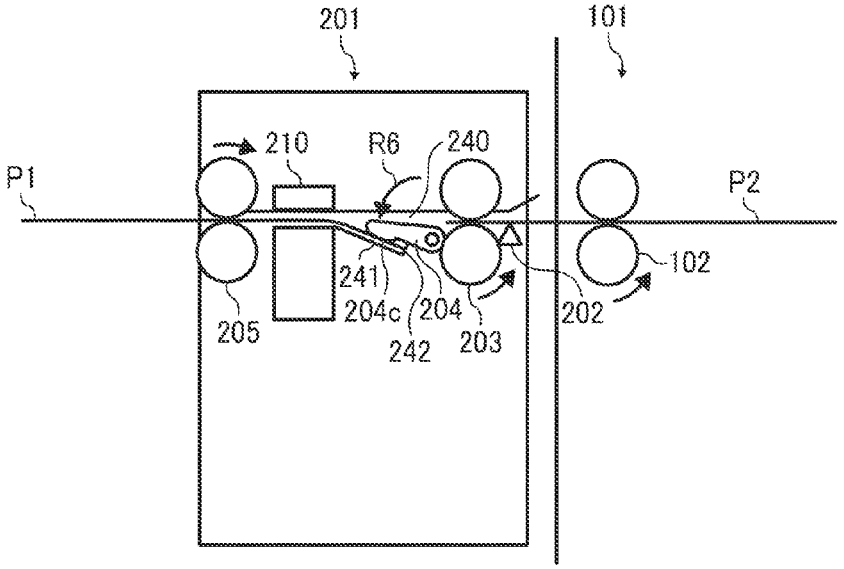

FIGS. 12A and 12B illustrate a state in which the first sheet P1 is retained in the bifurcation channel 241, and the second sheet P2 is received in the sheet processing apparatus 201. After the preceding first sheet P1 is aligned by the contact face 242, the branch pawl 204 rotates in the direction indicated by arrow R6 shown in FIG. 12B. With this operation, a lower face 204*c* (hereinafter "pressing face 204*c*") of the branch pawl 204 presses the trailing end of the sheet, which is positioned in the bifurcation channel 241, against a lower face of the bifurcation channel 241 to keep the first sheet P1 from moving. When the second sheet P2 is received from the image forming apparatus 101, the entrance rollers 203 correct skew thereof similarly to the first sheet P1. Subsequently, the entrance rollers 203 and the discharge rollers 205 start rotating in the sheet conveyance direction simultaneously.

Figure 13A:
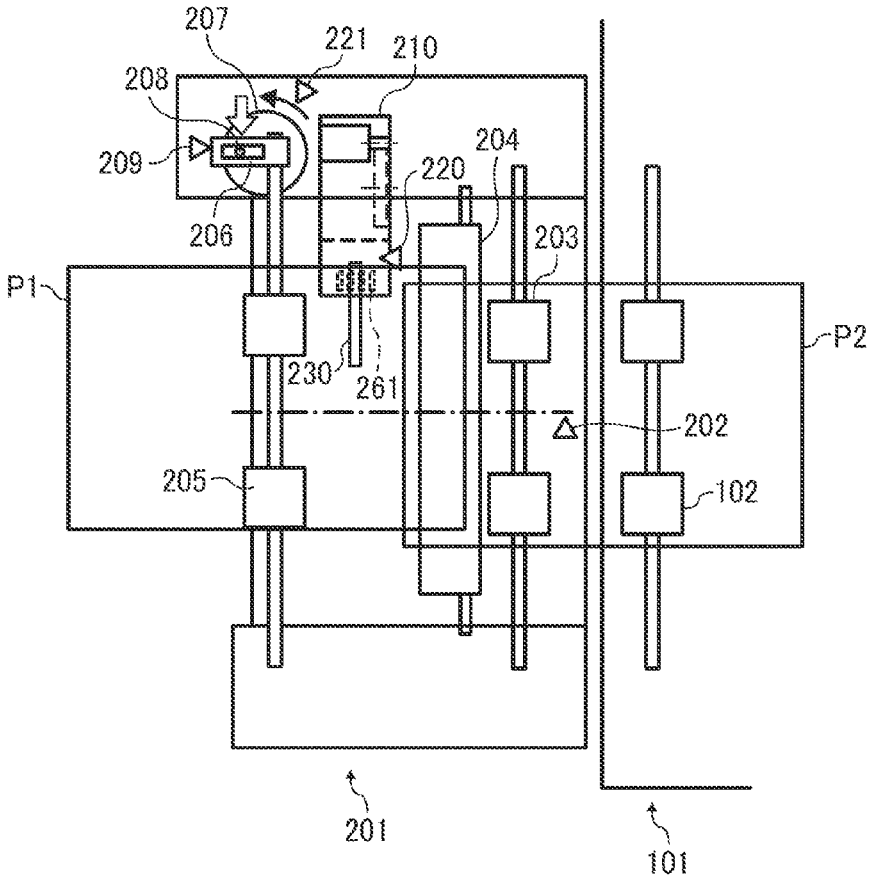
FIGS. 13A and 13B illustrate a state in which the second sheet is received in the sheet processing apparatus.
Figure 13B:
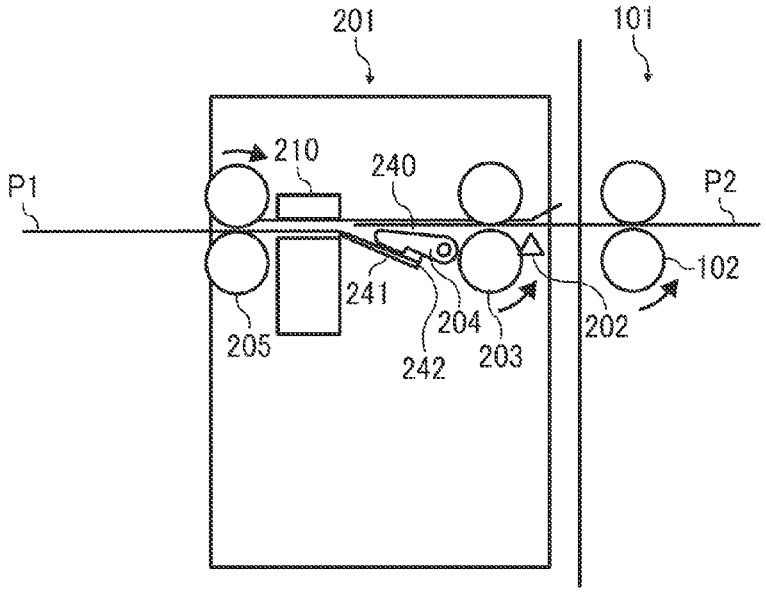

FIGS. 13A and 13B illustrate a state in which the second sheet P2 is received in the sheet processing apparatus 201. After the state shown in FIGS. 12A and 12B, as the subsequent sheets P3 through Pn are transported from the image forming apparatus 101, operations shown in FIGS. 10A through 11B are executed to sequentially transport the sheets P to a predetermined position and align the sheets P there. Thus, a sheet bundle 272 is stacked in the conveyance channel 240.

Figure 14A:
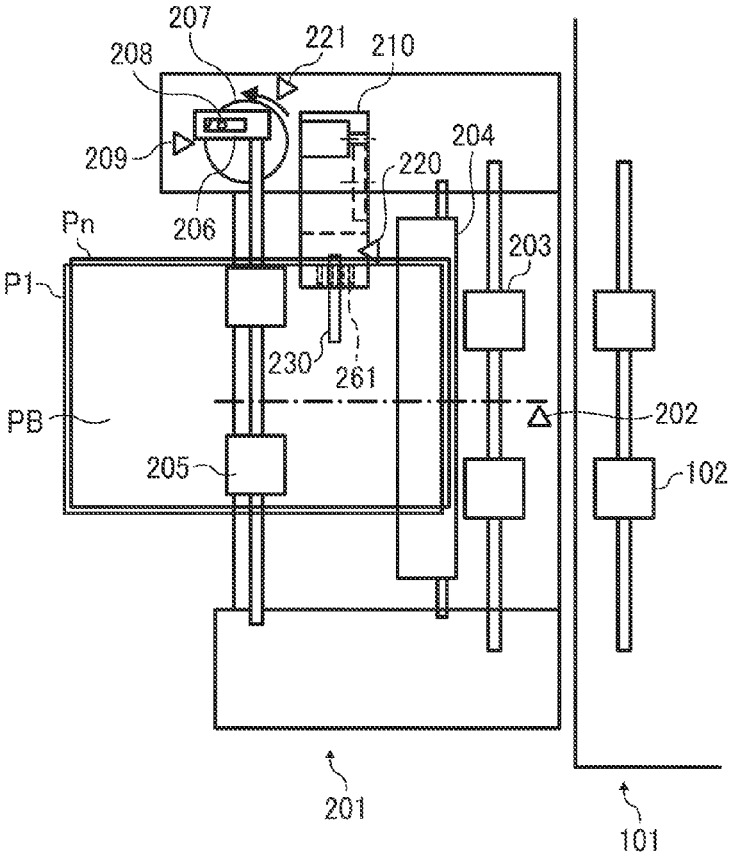
FIGS. 14A and 14B illustrate a state in which a last sheet is aligned with the preceding sheets, forming a sheet bundle.
Figure 14B:
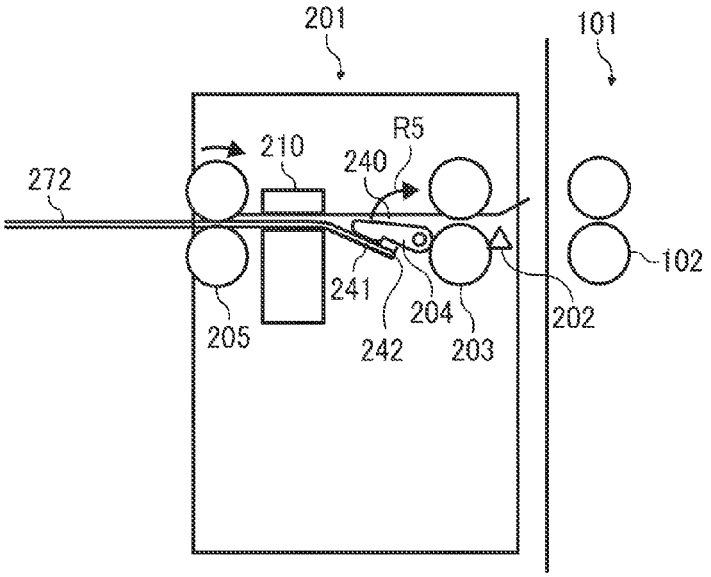

FIGS. 14A and 14B illustrate a state in which the last sheet Pn is aligned with the preceding sheets P, forming the sheet bundle 272. After the last sheet Pn is aligned and the sheet bundle 272 is farmed, the discharge rollers 205 are rotated a predetermined amount in the sheet conveyance direction. This operation can eliminate the slackening of the sheet P caused when the trailing end of the sheet P contacts the contact face 242. Subsequently, the branch pawl 204 rotates in the direction indicated by arrow R5 to disengage the pressing face 204*c* from the bifurcation channel 241, thereby canceling the pressure applied to the sheet bundle 272. Thus, the sheet bundle 272 is released from the branch pawl 204 and can be transported by the discharge rollers 205.

Figure 15A:
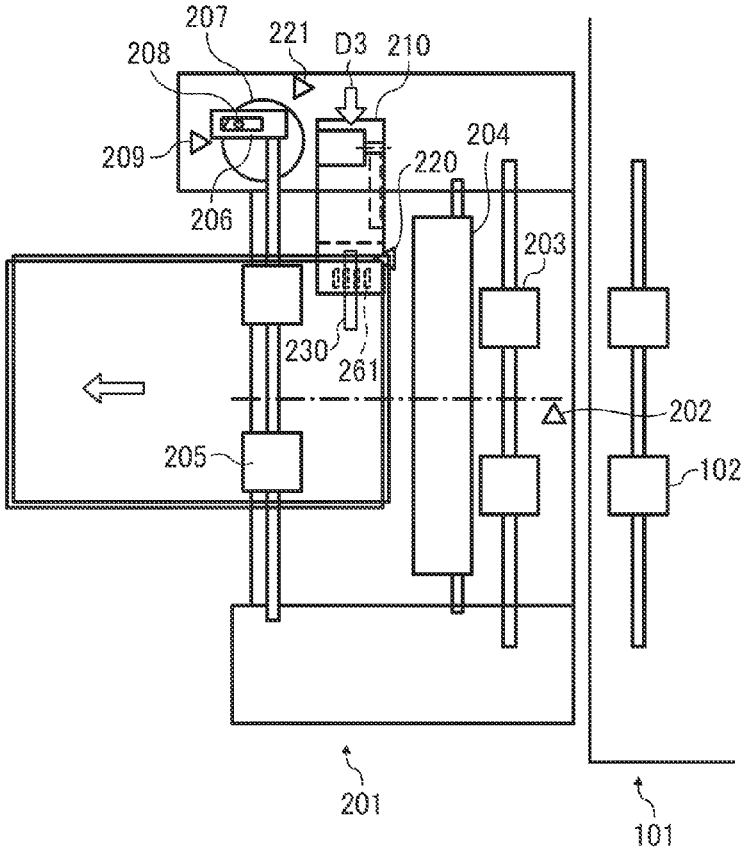
FIGS. 15A and 15B illustrate binding operation subsequent to the state shown in FIGS. 14A and 14B.
Figure 15B:
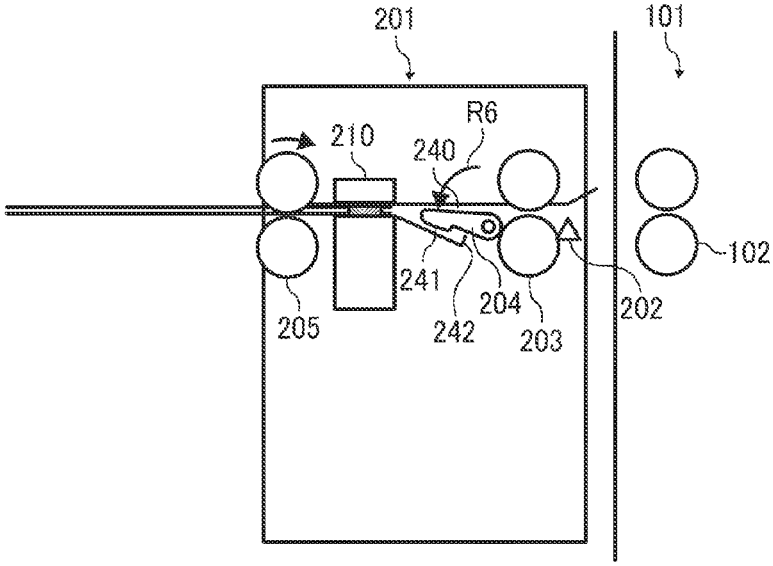

FIGS. 15A and 15B illustrate binding operation. After the state shown in FIGS. 14A and 14B, the discharge rollers 205 rotate in the sheet conveyance direction and stop when a binding position in the sheet bundle 272 reaches the pair of tooth forms 261 of the binding device 210. Thus, the binding position in the sheet bundle 272 is aligned with the position of the tooth forms 261 in the sheet conveyance direction. Additionally, the binding device 210 is moved in the direction indicated by arrow D3 shown in FIG. 15A (hereinafter "direction D3 or sheet width direction"), perpendicular to the sheet conveyance direction, until the pair of tooth forms 261 is aligned with the binding position in the sheet bundle 272 in the sheet width direction.

Accordingly, the binding position in the sheet bundle 272 is aligned with the tooth forms 261 in the sheet conveyance direction as well as the width direction. Then, the branch pawl 204 rotates in the direction indicated by arrow R6 shown in FIG. 15B and returns to the state for receiving the subsequent sheet P. Subsequently, the drive motor 265 is turned on, and the pair of tooth forms 261 squeezes the sheet bundle 272, thereby binding the sheet bundle 272 (i.e., clamp binding). It is to be noted that, although the description above concerns the binding device 210 employing clamp binding, other type of binding, for example, half blanking, lancing, and bending and inserting can be used instead.

Figure 16A:
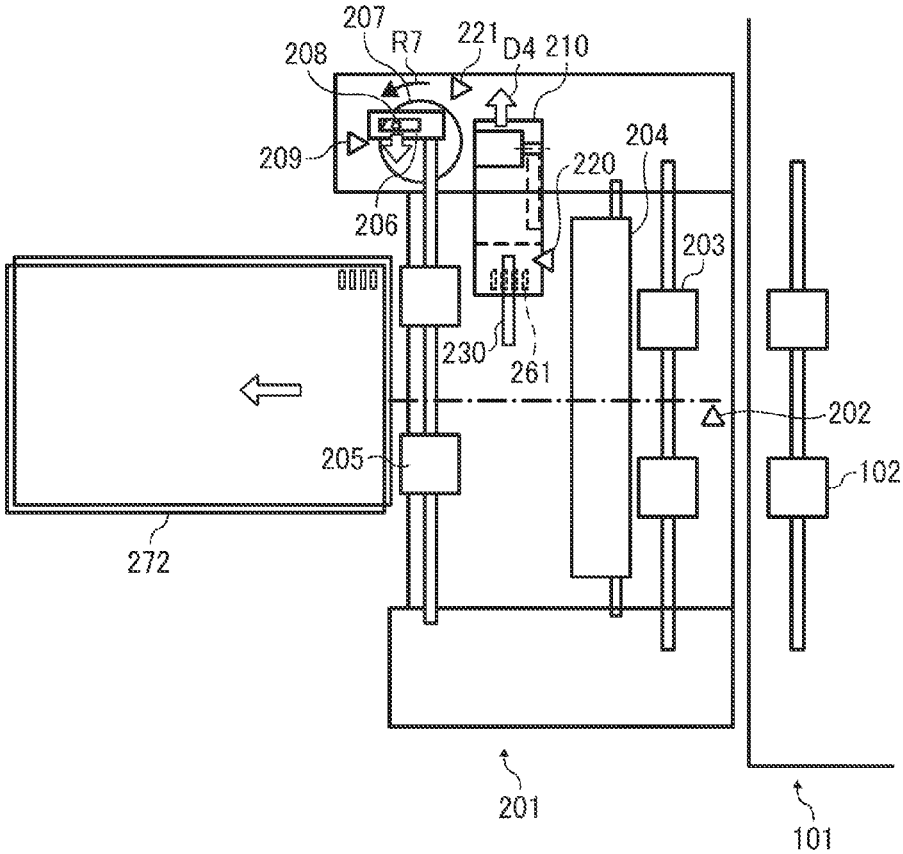
FIGS. 16A and 16B illustrate a state in which the sheet bundle is discharged.
Figure 16B:
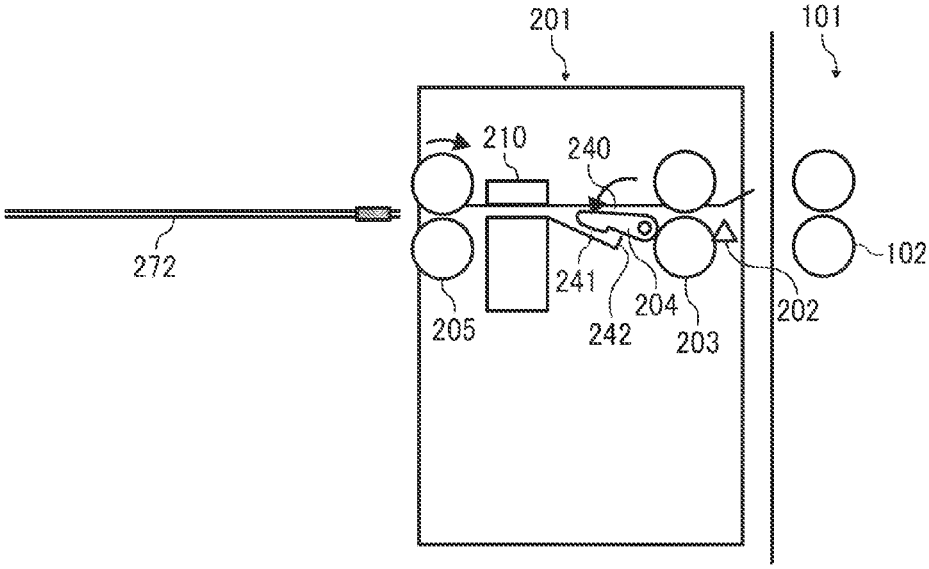

FIGS. 16A and 16B illustrate a state in which the sheet bundle 272 is discharged. After the sheet bundle 272 is bound together as shown in FIGS. 15A and 15B, the discharge rollers 205 rotate to discharge the sheet bundle 272. After the sheet bundle 272 is discharged, the shift cam 207 rotates in the direction indicated by arrow R7 shown in FIG. 16A to the home position (shown in FIG. 8A). In parallel to this operation, the binding device 210 moves in the direction indicated by arrow D4 shown in FIG. 16A to the home position shown in FIGS. 8A and 8B. Thus, alignment and binding of a single copy of sheets (a bundle of sheets) is completed. The operations shown in FIGS. 8A through 16B are repeated for binding subsequent copies, if any.

(First Embodiment)

A sheet binding device according to a first embodiment is described below.

As described above, clamp binding involves embossing a part of the sheet bundle and binding the sheets using friction force between the adjacent sheets in the embossed part. To generate the friction force, the sheets are clamped by a pair of tooth forms to cause fibers of the sheets to tangle with each other. When the sheet bundle is transported to the tooth forms, it is possible that the sheet bundle is caught by projections, resulting in defective binding or jamming of sheets. Although a guide may be provided for preventing defective binding or sheet jamming, it can increase the size, cost, or both of the apparatus.

In view of the foregoing, an aim of the present embodiment is to prevent defective binding, jamming of sheets, or both without increasing the size, cost, or both of the apparatus. It is to be noted that other aims, configurations, and effects of the present embodiment are also given in the description below. In the binding device according to the embodiment described below, a projection is configured to have an inclined face whose inclination relative to the sheet conveyance direction is set to prevent the sheet from being caught by the projection when the sheet contacts the projection. It is to be noted that other aims, configurations, and effects of embodiments of the present invention are also given in the description below.

Figure 17:
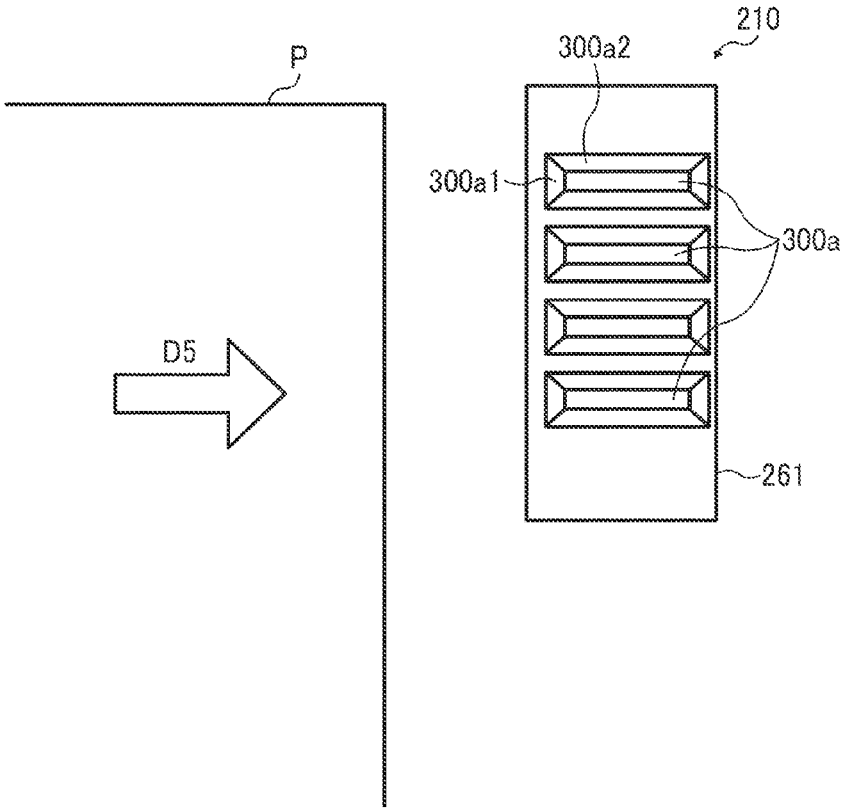
FIGS. 17 and 18 are respectively a plan view and a front view of a binding device according to a first embodiment and a sheet transported thereto.
Figure 18:
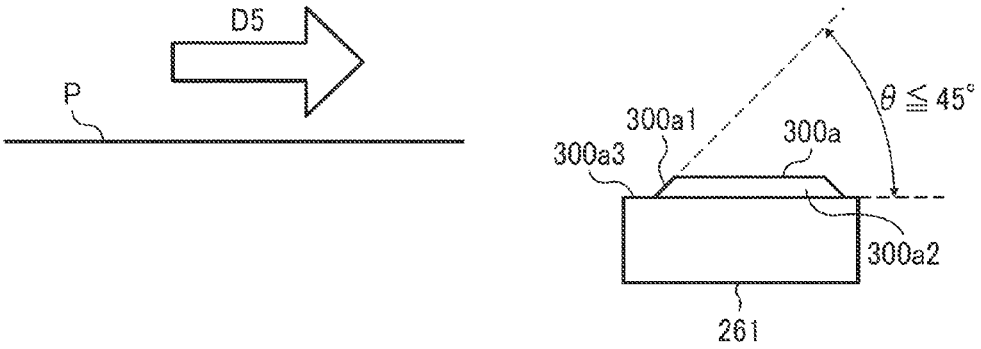

Referring to FIGS. 17 and 18, the relation between the binding device 210 and the sheet P (or sheet bundle 272) in the first embodiment is described below. FIGS. 17 and 18 are respectively a plan view and a front view of the binding device 210 and the sheet P transported thereto.

The binding device 210 includes the tooth forms 261 that are arranged vertically in pair. Each tooth form 261 has tooth that engage those of the other tooth form 261. It is to be noted that, although FIGS. 17 and 18 illustrate only the tooth form 261 on the lower side, the upper tooth form 261 has recesses to engage the tooth (i.e., projections 300*a*) of the lower tooth form 261 via the sheet bundle. Thus, the sheets can be embossed by the projections 300*a* and the recesses and bound together without using staples.

In the configuration shown in FIG. 17, the tooth form 261 includes four projections 300*a*, each of which extends parallel to the sheet conveyance direction indicated by arrow D5 (hereinafter "sheet conveyance direction D5"). The projection 300*a* form four rows arranged in the direction perpendicular to the sheet conveyance direction D5. The projection 300*a* has a quadrangular prismoid bottom face, and the long side thereof is parallel to the sheet conveyance direction D5.

Each projection 300*a* includes a first inclined face 300*a*1 on its short side and a second inclined face 300*a*2 on the long side of the projection 300*a*. As shown in FIG. 18, the first inclined face 300*a*1 faces the sheet conveyance direction D5, that is, on the upstream side in the sheet conveyance direction D5. In the first embodiment, an inclination θ of the first inclined face 300*a*1 relative to a base face 300*a*3 of the tooth form 261 is 45 degrees or smaller (θ≤45°). That is, the first inclined face 300*a*1 of the tooth form 261 is inclined 45 degrees or smaller relative to the sheet conveyance direction D5 since the base face 300*a*3 parallels the sheet conveyance direction D5 in the present embodiment.

Thus, the projection 300*a* includes the first inclined face 300*a*1 that faces the sheet conveyance direction D5 and has a mild inclination θ. This configuration can inhibit the tooth forms 261 from catching the sheets P passing therebetween. Accordingly, jamming of sheets can be inhibited.

(Second Embodiment)

Description is given below of a second embodiment in which each of multiple projections of the tooth form 261 extends perpendicular to the sheet conveyance direction D5.

Figure 19:
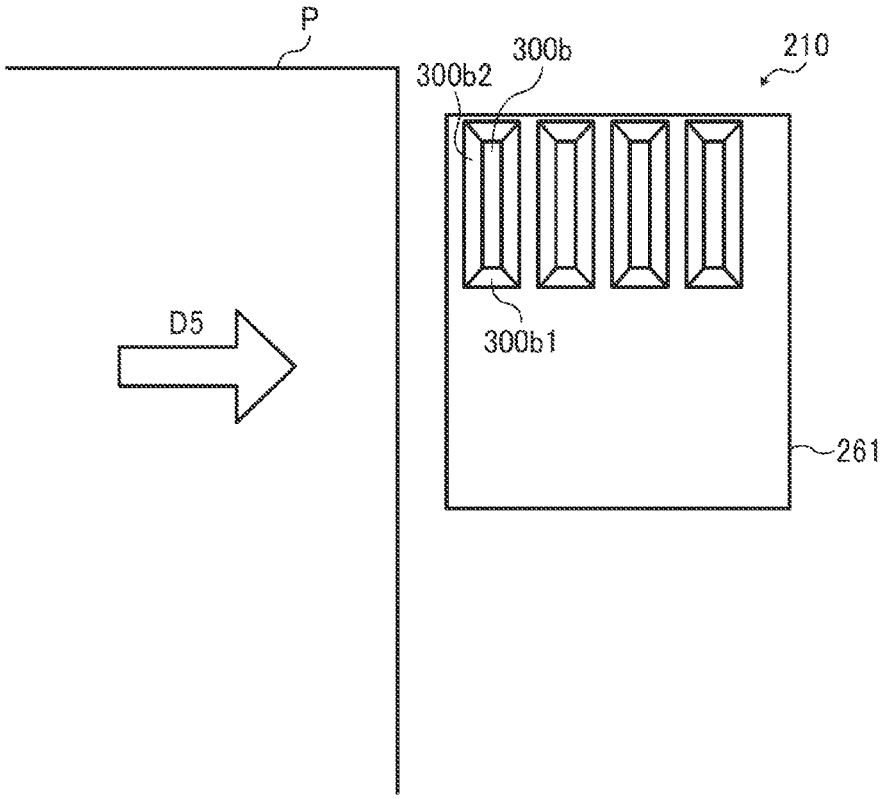
FIGS. 19 and 20 are respectively a plan view and a front view of a binding device according to a second embodiment and the sheet transported thereto.
Figure 20:
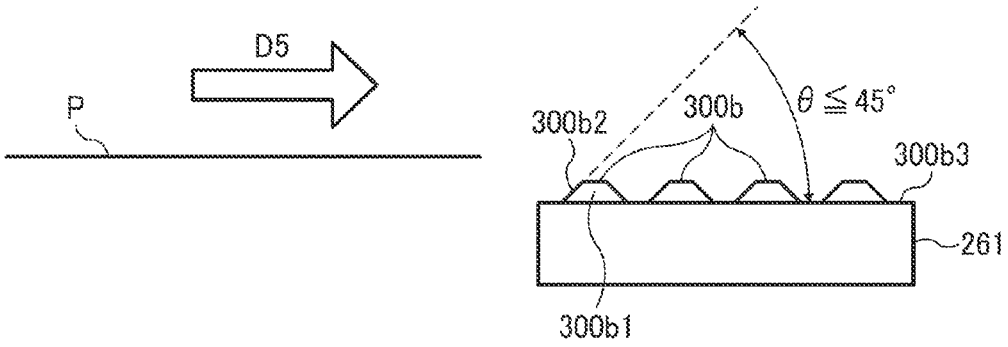

FIGS. 19 and 20 illustrates the relation between the binding device 210 and the sheet P (or sheet bundle 272) in the second embodiment. FIGS. 19 and 20 are respectively a plan view and a front view of the binding device 210 and the sheet P transported thereto.

Specifically, projections 300*b* of the tooth form 261 according to the second embodiment are similar in shape to the projections 300*a* in the first embodiment, and the direction of arrangement thereof is different from that in the first embodiment. Similarly to the projection 300*a* of the first embodiment, the projection 300*b* includes first and second inclined faces 300*b*1 and 300*b*2. The second inclined face 300*b*2 on the long side faces the sheet conveyance direction (i.e., on the upstream side in the sheet conveyance direction), and an inclination θ of the second inclined face 300*b*2 relative to a base face 300*b*3 of the tooth form 261 is 45 degrees or smaller (θ≤45°).

In the second embodiment, the inclination θ of the second inclined face 300*b*2 (i.e., the inclined face that is on the upstream side in the sheet conveyance direction) is thus mild. This configuration can inhibit the tooth forms 261 from catching the sheets P passing therebetween. Accordingly, jamming of sheets can be inhibited.

Except the differences described above, the configuration of the second embodiment and effects attained thereby are similar to the above-described first embodiment.

(Third Embodiment)

Figure 21:
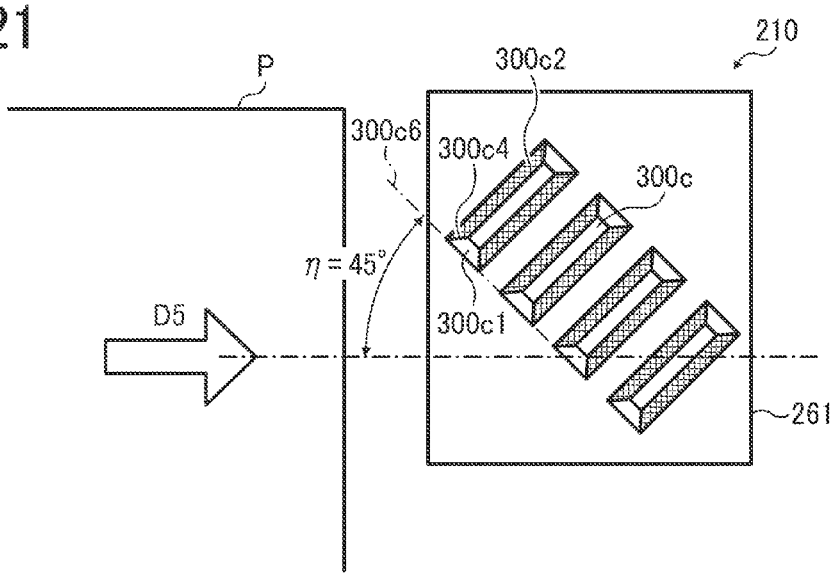
FIG. 21 is a plan view of a binding device according to a third embodiment and the sheet transported thereto.
Figure 22:
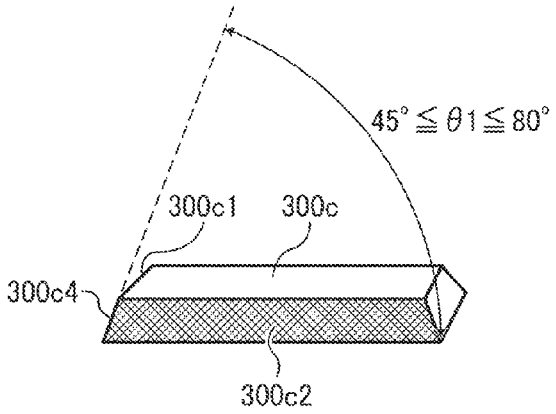
FIG. 22 is a perspective view of a projection of a tooth form according to the third embodiment.
Figure 23:
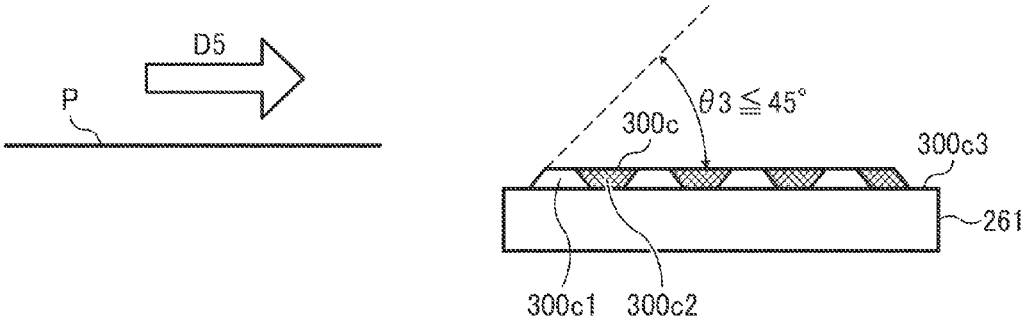
FIG. 23 is a front view of the binding device and the sheet shown in FIG. 21.

A third embodiment is described with reference to FIGS. 21 through 23 that illustrate the relation between the binding device 210 and the sheet P (or sheet bundle 272) in the third embodiment. FIG. 21 is a plan view of the binding device 210 and the sheet P transported thereto, FIG. 22 is a perspective view of a projection of a tooth form according to the third embodiment, and FIG. 23 is a front view of the binding device 210 and the sheet P shown in FIG. 21.

Referring to FIG. 21, the sheet P is transported toward the binding device 210 in the direction D5. The tooth form 261 of the binding device 210 according to the third embodiment includes four projections 300*c* disposed oblique to the sheet conveyance direction D5, more specifically, at an angle η to the sheet conveyance direction D5. The short side (on the upstream side in the Direction D5) of each projection 300*c* is aligned with a line 300*c*6, and the angle η between the sheet conveyance direction D5 and the line 300*c*6 is 45 degrees, for example. Both the short side and the long side of each projection 300*c* are inclined 45 degrees relative to the sheet conveyance direction D5. The projection 300*c* has first and second inclined faces 300*c*1 and 300*c*2, and inclination thereof to the sheet conveyance direction D5 is different from that in the first embodiment.

Specifically, in the third embodiment, an inclination θ1 of the first inclined face 300*c*1, on the short side, relative to the base face 300*c*3 is within a range of from 45 to 80 degrees (45°≤θ1≤80°). Referring to FIG. 22, a ridgeline 300*c*4 is formed by the first and second inclined faces 300*c*1 and 300*c*2, and an inclination of the ridgeline 300*c*4 relative to the base face 300*c*3 is referred to as an inclination θ3 shown in FIG. 23. An inclination of the second inclined face 300*c*2, on the long side, relative to the base face 300*c*3 is designed to set the inclination θ3 is 45 degrees or smaller (θ3≤45°). The inclination θ3 is 45 degrees or smaller similarly in the front view of the tooth form 261 shown in FIG. 23.

When the inclination θ1 is determined, the inclination of the second inclined face 300*c*2 is determined within a given range relative to the inclination θ3. Thus, the inclinations θ1 and θ3 and the inclination of the second inclined face 300*c*2 are relative to each other. Accordingly, the correlation among them can be predetermined so that the inclination of the second inclined face 300*a*2 and the inclination θ3 can be selected according to the predetermined correlation when the inclination θ1 is determined.

It is to be noted that, although the inclination θ1 is desirably 45 degrees or greater for attaining a stronger binding strength, the inclination of the second inclined face 300*c*2 is reduced as the inclination θ1 increases. Accordingly, the upper limit of the inclination θ1 is about 80 degrees, for example. By contrast, as the inclination of the second inclined face 300*c*2 decreases, the binding strength on the second inclined face 300*c*2 on the long side is weakened. Further, the binding strength depends on the size of the projection 300*c*, (i.e., the long side length the short side length, and height) and the thickness of the sheet bundle. Accordingly, it is preferable that the relation between the respective inclinations and the binding strength is obtained experimentally using those variables so that desirable inclinations are selected according to the predetermined correlations.

Referring to FIG. 22, the inclination θ1 of the first inclined face 300*c*1 on the short side of the projection 300*c*, relative to the base face 300*c*3, is selected within the range of 45°≤θ1≤80°, and the inclination of the second inclined face 300*c*2 on the long side of the projection 300*c*, relative to the base face 300*c*2, is selected so that the inclination η of the ridgeline 300*c*4 is 45 degrees or smaller.

Referring to FIG. 23 that illustrates the tooth form 261 as viewed from the front side in FIG. 21, in the third embodiment, the first inclined face 300*c*1 on the short side is designed to have the inclination of 45°≤θ1≤80°, and the inclination θ3 of the ridgeline 300*c*4 facing the sheet conveyance direction D5 serves as the inclination of the tooth form 261 relative to the sheet conveyance direction D5 since the long side of the projection 300*c* is at 45 degrees to the sheet conveyance direction D5. Specifically, the inclination θ3 of the ridgeline 300*c*4 is 45 degrees or smaller as viewed in the direction perpendicular to the sheet conveyance direction D5.

Thus, when the projection 300*c* is oblique to the sheet conveyance direction D5, the upstream end of the projection 300*c* (i.e., the ridgeline 300*c*4 facing the sheet conveyance direction) has a mild inclination even if the inclination of the first inclined face 300*c*1 on the short side is steep. This configuration can increase the binding strength and prevent the sheets from being caught by the projections 300*c* of the tooth forms 261 while the sheets pass therebetween.

Except the differences described above, the configuration of the third embodiment and effects attained thereby are similar to those of the above-described first or second embodiment.

(Fourth Embodiment)

Figure 24:
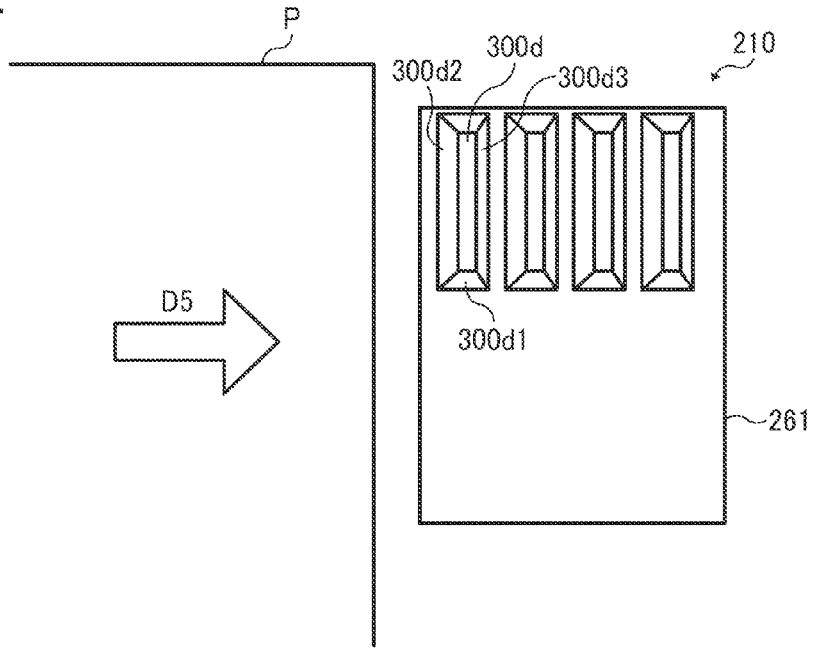
FIG. 24 is a plan view of a binding device according to a fourth embodiment and the sheet P transported thereto.
Figure 25:
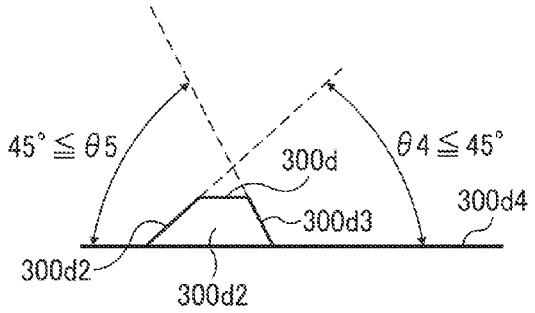
FIG. 25 is a front view of a projection of a tooth form according to the fourth embodiment.
Figure 26:
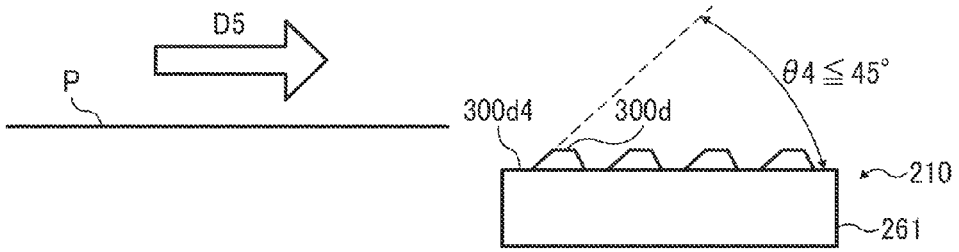
FIG. 26 is a front view of the binding device and the sheet shown in FIG. 24.

Referring to FIGS. 24 through 26, the relation between the binding device 210 and the sheet P (or sheet bundle 272) in a fourth embodiment is described below. FIG. 24 is a plan view of the binding device 210 and the sheet P transported thereto, FIG. 25 is a front view of a projection of a tooth form according to the fourth embodiment, and FIG. 26 is a front view of the binding device 210 and the sheet P shown in FIG. 24.

The tooth forms 261 according to the fourth embodiment are configured such that the projections 300*b* according to the second embodiment are disposed perpendicular to the sheet conveyance direction D5.

Specifically, the tooth form 261 according to the fourth embodiment include projections 300*d* each including a first inclined face 300*d*1 on the short side and a second inclined face 300*d*2 on the long side. The second inclined face 300*d*2 is on the upstream side of the projection 300*d* in the sheet conveyance direction D5, that is, faces the sheet conveyance direction D5. The projection 300*d* is similar to the projection 300*b* shown in FIG. 19 in that an inclination θ4 of the second inclined face 300*d*2 on the upstream side relative to a base face 300*d*4 is 45 degrees or smaller. The projection 300*d* further includes a third inclined face 300*d*3 on the downstream side (on the long side), and an inclination θ5 of the third inclined face 300*d*3 relative to the base face 300*d*4 is 45 degrees or greater. The first inclined face 300*d*1 on the short side has an inclination of 45 degrees or greater relative to the base face 300*d*4. Other configurations are similar to those of the second embodiment.

In the fourth embodiment, similarly, the inclination of the inclined face (i.e., the second inclined face 300*d*2) relative to the sheet conveyance direction D5 is thus mild. This configuration can inhibit the tooth forms 261 from catching the sheets P being passing therebetween. By contrast, other inclined faces 300*d*1 and 300*d*3 are steeper, in particular, 45 degrees or greater. In this case, the upper limit is preferably about 80 degrees. With this configuration, sheets can be clamped at a relatively steep inclination.

It is to be noted that, although the inclination θ4 on the upstream side is 45 degrees or smaller in all the projections 300*d* in the fourth embodiment, alternatively, the inclination θ4 on the upstream side of only the extreme upstream projection 300*d* (the first projection 300*d* from the left in FIG. 24) may be 45 degrees or smaller. Such a configuration can prevent the sheets from being caught by the tooth form 261 and increase the binding strength.

Except the differences described above, the configuration of the fourth embodiment and effects attained thereby are similar to the above-described first and second embodiments.

It is to be noted that, in the above-described embodiments, the inclination of the upstream inclined face equals to an angle formed by the inclined face and the base face of the projection on a cross section perpendicular to the bottom side of the inclined face.

As described above, the present embodiment can attain the following effects.

1) The sheet binding device 210 includes the pair of tooth forms 261 to squeeze, clamp, and bind together a sheet bundle constructed of multiple sheets lying one on top of another. The sheet bundle is squeezed and deformed between the upper tooth form 261 having multiple projections (such as the projections 300*a*, 300*b*, 300*c*, and 300*d*) and the lower tooth form 261 having multiple recesses to engage the respective projections of the upper tooth form 261 via the sheet bundle so that the squeezed portions are bonded to each other without glue. The side (the inclined face 300*a*1, 300*b*2, or 300*d*2; or the ridgeline 300*c*4) of the projection facing the sheet conveyance direction has an inclination of 45 degrees or smaller relative to a face (such as the base face 300*a*3 of the projection 300*a*) parallel to the sheet conveyance direction.

This configuration can prevent the sheet transported between the tooth forms 261 from being caught by the upstream side of the projection. This effect can be attained by changing the shape or arrangement of the projections of the tooth forms 261 without changing the mechanism of the binding device 210. Therefore, defective binding, jamming of sheets, or both can be prevented without increasing the size, cost, or both of the apparatus.

2) The projections 300*a* projecting from the base face 300*a*3 are prismoidal, and their bottom faces are rectangular. The first inclined face 300*a*1 on the short side of the projection 300*a* is inclined relative to the sheet conveyance direction. Accordingly, even if the sheet entering the binding device 210 contacts the short sides of the respective projections 300*a*, the sheet can escape upward along the first inclined faces 300*a*1 and is not caught by the multiple projections 300*a*.

3) The projection 300*b* projecting from the base face 300*b*3 is shaped into a prismoid whose bottom face is rectangular. The second inclined face 300*a*1 on the long side of the projection 300*b* is on the upstream side and inclined relative to the sheet conveyance direction. Accordingly, even if the sheet entering the binding device 210 contacts the long side of the extreme upstream projection 300*b*, the sheet can escape upward along the second inclined face 300*b*2 and is not caught by the projection 300*b*.

4) The projection 300*c* projecting from the base face 300*c*3 is shaped into a prismoid whose bottom face is rectangular. The ridgeline 300*c*4 between the first inclined face 300*c*1 on the short side and the second inclined face 300*c*2 on the long side is extreme upstream in the sheet conveyance direction and inclined relative to the sheet conveyance direction. Accordingly, even when the sheet contacts the ridgeline 300*c*4, the sheet can escape upward along the inclined ridgeline 300*c*4. For example, the ridgeline 300*c*4 can be disposed extreme upstream when the angle η between the sheet conveyance direction D5 and the line 300*c*6 connecting the short sides (on the upstream side) of the respective projections 300*c* is, for example, about 45 degrees, and both the short side and the long side of each projection 300*c* is inclined relative to the sheet conveyance direction D5. Thus, this arrangement can be easier.

5) Strong clamping force can be attained since either of the first inclined face 300*c*1 on the short side or the second inclined face 300*c*2 on the long side is inclined within the range from 45 degrees to 80 degrees relative to the base face 300*c*3.

The inclination of the first inclined face 300*a*1 or the second inclined face 300*b*2 is 45 degrees or smaller. Accordingly, when the leading end of the sheet contacts the first inclined face 300*a*1 or the second inclined face 300*b*2, the sheet can be reliably guided upward. Thus, the sheet can be prevented from jamming.

7) Among the multiple projections 300*d*, the extreme upstream projection 300*d* in the sheet conveyance direction has the upstream inclined face 300*d*2, and the upstream inclined face 300*d*2 is inclined within 45 degrees relative to the base face 300*d*4. Accordingly, when the leading end of the sheet contacts the inclined face 300*d*2, the sheet can be reliably guided upward. Thus, the sheet can be prevented from jamming.

8) When the projection 300*d* further includes the inclined face 300*d*3 inclined 45 degrees or greater relative to the sheet conveyance direction, other than the upstream inclined face 300*d*2 inclined 45 degrees or smaller relative to the sheet conveyance direction, jamming of the sheet can be prevented by the inclined face 300*d*2 while strong clamping force can be attained by the inclined face 300*d*3.

It is to be noted that the present invention is not limited to the specific embodiments described above, and numerous additional modifications and variations are possible in light of the above teachings. It is therefore to be understood that, the disclosure of this patent specification may be practiced otherwise than as specifically described herein, and such variations, modifications, alternatives are within the technical scope of the appended claims.

What is claimed is:

1. A sheet processing apparatus comprising:

a conveyance unit to transport a sheet bundle including multiple sheets in a sheet conveyance direction; and a binding device including a clamping unit that includes upper and lower opposing tooth forms and multiple projections and multiple recesses to engage the respective projections to clamp the sheet bundle inserted therebetween, wherein at least one of the multiple projections includes an inclined portion facing a sheet conveyance direction, and an inclination of the inclined portion is 45 degrees or smaller relative to a face parallel to the sheet conveyance direction, wherein the projections include a rectangular top face.

2. The sheet processing apparatus according to claim 1, wherein the clamping unit further comprises a base face from which the multiple projections project, the projection including the inclined portion is prismoidal and have a rectangular bottom face, and the inclined portion facing the sheet conveyance direction is a face on either a short side or a long side of the projection.

3. The sheet processing apparatus according to claim 2, wherein the multiple projections are arranged in a direction perpendicular to the sheet conveyance direction, and each of the multiple projections comprises the inclined portion facing the sheet conveyance direction on the short side of the projection.

4. The sheet processing apparatus according to claim 2, wherein the projection including the inclined portion is positioned extreme upstream among the multiple projections in the sheet conveyance direction.

5. The sheet processing apparatus according to claim 2, wherein the projection including the inclined portion further comprises a face inclined 45 degrees or greater relative to the sheet conveyance direction.

6. The sheet processing apparatus according to claim 1, wherein the clamping unit further comprises a base face from which the multiple projections project, the projection including the inclined portion is prismoidal and have a rectangular bottom faces, and the inclined portion is a ridgeline formed by an inclined short side face and an inclined long side face of the projection.

7. The sheet processing apparatus according to claim 6, wherein either the inclined short side face and the inclined long side face of the projection has an inclination within a range from 45 degrees to 80 degrees relative to the base face of the projection.

8. An image forming system comprising:

an image forming apparatus; and the sheet processing apparatus according to claim 1.

9. The sheet processing apparatus according to claim 1, wherein each of the upper and lower tooth forms include the multiple projections arranged on the opposing surfaces of the upper and lower tooth forms.

10. The sheet processing apparatus according to claim 9, wherein the projections of the upper and lower tooth forms are interposed in respective recesses between projections during a clamping operation.

* * * * *